US009254951B2

(12) United States Patent
Merritt

(10) Patent No.: US 9,254,951 B2
(45) Date of Patent: Feb. 9, 2016

(54) ADVANCED CONDIMENT DISPENSING DEVICE

(76) Inventor: Alyse N. Merritt, Tampa, FL (US)

( * ) Notice: Subject to any disclaimer, the term of this patent is extended or adjusted under 35 U.S.C. 154(b) by 619 days.

(21) Appl. No.: 13/589,312

(22) Filed: Aug. 20, 2012

(65) Prior Publication Data

US 2014/0048429 A1 Feb. 20, 2014

(51) Int. Cl.
*A45C 11/20* (2006.01)
*B65D 81/32* (2006.01)

(52) U.S. Cl.
CPC ..... *B65D 81/3266* (2013.01)

(58) Field of Classification Search
USPC ..... 206/484.1, 484, 484.2, 541; 220/255, 220/916, 4.21, 4.24, 4.25, 4.26, 4.27, 23.4, 220/522; 222/94, 153.02
See application file for complete search history.

(56) References Cited

U.S. PATENT DOCUMENTS

| | | | | |
|---|---|---|---|---|
| 708,709 | A | 9/1902 | Henneberry et al. | |
| 817,890 | A | 4/1906 | Williams | |
| 2,248,266 | A | 7/1941 | Abrams | |
| 2,517,027 | A * | 8/1950 | Rado | 222/94 |
| 2,550,132 | A | 4/1951 | Woods | |
| 2,899,110 | A * | 8/1959 | Parker | 222/215 |
| 3,063,601 | A | 11/1962 | Hertz | |
| 3,092,277 | A * | 6/1963 | Brim | 215/12.1 |
| 3,184,121 | A | 5/1965 | Colckening | |
| 3,224,640 | A | 12/1965 | Schneider et al. | |
| 3,418,059 | A | 12/1968 | Robe | |
| 3,913,789 | A | 10/1975 | Miller | |
| 4,225,255 | A | 9/1980 | Braun et al. | |
| 4,252,257 | A | 2/1981 | Herzig | |
| 4,369,883 | A * | 1/1983 | Stravitz | 206/387.15 |
| 4,644,732 | A | 2/1987 | Morton | |
| 4,790,429 | A | 12/1988 | Fukushima | |
| 4,872,556 | A | 10/1989 | Farmer | |
| 4,903,842 | A | 2/1990 | Tokuda et al. | |
| 5,265,749 | A * | 11/1993 | Zutler | 220/4.24 |
| 5,316,400 | A * | 5/1994 | Hoyt et al. | 401/132 |
| 5,330,075 | A | 7/1994 | Brown, Sr. | |
| 5,377,874 | A | 1/1995 | Brown | |
| 5,395,031 | A | 3/1995 | Redmond | |
| 5,823,391 | A * | 10/1998 | Klauke et al. | 222/94 |
| D417,848 | S | 12/1999 | Marshall | |
| 6,174,083 | B1 | 1/2001 | Delefortie et al. | |
| 6,182,847 | B1 * | 2/2001 | Shu | 220/4.21 |
| 6,360,916 | B1 | 3/2002 | Sokolsky et al. | |
| 6,935,783 | B2 | 8/2005 | Carter | |
| 6,951,314 | B2 | 10/2005 | Tang | |
| 7,121,409 | B1 | 10/2006 | Hamilton et al. | |
| 7,241,066 | B1 | 7/2007 | Rosen et al. | |
| 7,325,703 | B2 | 2/2008 | Gherdan et al. | |
| 7,325,994 | B2 | 2/2008 | Liberatore | |

(Continued)

*Primary Examiner* — Jacob K Ackun
(74) *Attorney, Agent, or Firm* — Patent CEO; Phillip Vales

(57) ABSTRACT

A condiment dispensing device is formed from two containers held together with interlocking nozzle plug pairs. The device has first and second enclosed surfaces that hold the condiment within to dispense through the passageways formed within the nozzles. The nozzle plug pairs alternate on each container surface and are interlocked along a central zone by corresponding alternating nozzle and plugs; a plug from one container closes the hole passageway in the nozzle from another container. Each of the nozzles and plugs are located on an end of the one of the two container located between the two containers; each of these containers is arranged end to end. Another embodiment has a simple neck that stretches out from a typical package providing a simple spout design for condiment dispensing.

16 Claims, 5 Drawing Sheets

(56) References Cited

U.S. PATENT DOCUMENTS

| | | | | |
|---|---|---|---|---|
| 7,374,046 | B1 | 5/2008 | O'Brien | |
| 8,684,218 | B1 * | 4/2014 | Stravitz | 220/504 |
| 2001/0045374 | A1 | 11/2001 | Selker | |
| 2004/0112928 | A1 | 6/2004 | Brient | |
| 2006/0237477 | A1 | 10/2006 | Gregg | |
| 2007/0029275 | A1 * | 2/2007 | Hantman et al. | 215/6 |
| 2007/0045154 | A1 * | 3/2007 | Gelardi et al. | 206/736 |
| 2007/0119862 | A1 | 5/2007 | Backes et al. | |
| 2007/0253761 | A1 * | 11/2007 | May | 401/133 |
| 2012/0181269 | A1 * | 7/2012 | Rubenson et al. | 220/4.24 |
| 2012/0298659 | A1 * | 11/2012 | Bogner | 220/200 |
| 2013/0134161 | A1 * | 5/2013 | Fogel | 220/23.83 |

* cited by examiner

ADVANCED CONDIMENT DISPENSING DEVICE

FIELD OF THE INVENTION

The present invention relates to a system for dispensing condiments more efficiently, and more particularly, for improving the dining experience of restaurant patrons by providing more variety in the condiment package as well as an easier way to open a condiment package.

BACKGROUND OF THE INVENTION

Condiments are consumed in all sorts of restaurants and homes and are added to dishes in order to enhance the dining experience. The reason for adding condiments to a specific food item can range from the desire to add a particular flavor to the dish, accentuate the same or even to supplement the flavors already present within the food item.

There are a variety of sauces and seasoning that are commonly available in condiment packets; typically, fast food restaurants carry the ubiquitous ketchup and mustard condiments and some carry mayonnaise. Each of the servings is available in a single plastic package usable only once. Such a packet is known commonly as a sachet.

These small sachets are typically rectangular in shape and are made from a variety of common man made materials such as tin foil, mylar, plastic or similar materials. The packet is formed from two separate rectangular pieces of material that are brought into close proximity. Once three sides of each of the two rectangular pieces are brought together, these six sides are heat treated with a heating device at the edges to form a three sided pocket container.

Then another device inserts a condiment into the packet for later use. The final two edges of the bottom and top rectangular pieces are brought into physical proximity to each other through the aegis of another device. In this final step of sealing the sachet, a similar heating process closes the final edges between the top and bottom pieces so as to form a completed rectangular condiment package.

However, this typical type of condiment packet suffers from the fact that it can only dispense a single type of condiment. Additionally, as many patrons of fast food and other types of restaurants know, sometimes the sachet is inflexible and will not permit the easy release of the condiment held within. As almost everyone has experienced, the part of the device that is supposed to tear away allowing for easy dispensing of the condiment sometimes simply will not rip apart.

Accordingly, there is a need to overcome the prior art deficiencies as indicated above.

SUMMARY OF THE INVENTION

The present invention overcomes the deficiencies of the known art and the problems that remain unsolved by providing various novelties that will described presently.

A first embodiment teaches a system for containment of fluid materials, having a first container having a top and bottom surfaces attached to each other along their respective borders having an interior cavity formed between the top and bottom surfaces and integrated at one end with a first nozzle having a first hole in the end, said first hole forming a passageway communicative with an interior of said first container; a first surface integrally associated with an exterior surface of said first nozzle wherein the first surface also has a first plug adjacently formed on the first surface to the exterior surface of said first nozzle.

The system further has a second container also having another top and bottom surfaces attached to each other along their respective borders having another interior cavity formed between the another top and bottom surfaces and integrated at one end with a second nozzle having a second hole in the end, said second hole forming a passageway communicative with an interior of said second container. Further, the second container has a second surface integrally associated with an exterior surface of said second nozzle wherein the second surface also has a second plug adjacently formed on the second surface to the exterior surface of said second nozzle. The first container first plug is inserted into the second container second hole so that they cooperate in a closed mode to block fluid flow out of the second container. Next, the second plug is inserted into the first hole so that they cooperate in a closed mode to block fluid flow out of the first container. The system further includes the first container having a third nozzle having a third hole in the end, said third hole forming a passageway communicative with an interior of said first container; a third surface integrally associated with an exterior surface of said third nozzle wherein the third surface also has a third plug adjacently formed on the third surface to the exterior surface of said third nozzle. The other container has a fourth nozzle having a fourth hole in the end, said fourth hole forming a passageway communicative with an interior of said second container; a fourth surface integrally associated with an exterior surface of said fourth nozzle wherein the fourth surface also has a fourth plug adjacently formed on the fourth surface to the exterior surface of said fourth nozzle. To appreciate how the device is put together one understands that the third plug is inserted into the fourth hole so that they cooperate in a closed mode to block fluid flow out of the second container and that the fourth plug is inserted into the third hole so that they cooperate in a closed mode to block fluid flow out of the first container. Then the first container has a fifth nozzle having a fifth hole in the end, said fifth hole forming a passageway communicative with an interior of said first container; a fifth surface integrally associated with an exterior surface of said fifth nozzle wherein the fifth surface also has a fifth plug adjacently formed on the fifth surface to the exterior surface of said fifth nozzle. Next the second container has a sixth nozzle having a sixth hole in the end, said sixth hole forming a passageway communicative with an interior of said second container; a sixth surface integrally associated with an exterior surface of said sixth nozzle wherein the sixth surface also has a sixth plug adjacently formed on the sixth surface to the exterior surface of said sixth nozzle. Thus, to appreciate how the device is put together, one realizes that the fifth plug is inserted into the sixth hole so that they cooperate in a closed mode to block fluid flow out of the second container whilst the sixth plug is inserted into the fifth hole so that they cooperate in a closed mode to block fluid flow out of the first container. One property of the arrangement is that the first and second container have separable cooperative retention of both containers in order to keep them as a single system. The first and second containers have separable cooperative retention of both containers in order to keep them as a single system such that mechanism used to keep the containers together is the friction between said nozzles. Further the first and second containers have separable cooperative retention of both containers in order to keep them as a single system such that mechanism used to keep the containers together are retentive notches.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate the novelties taught herein.

DETAILED DESCRIPTION

Figure 1:
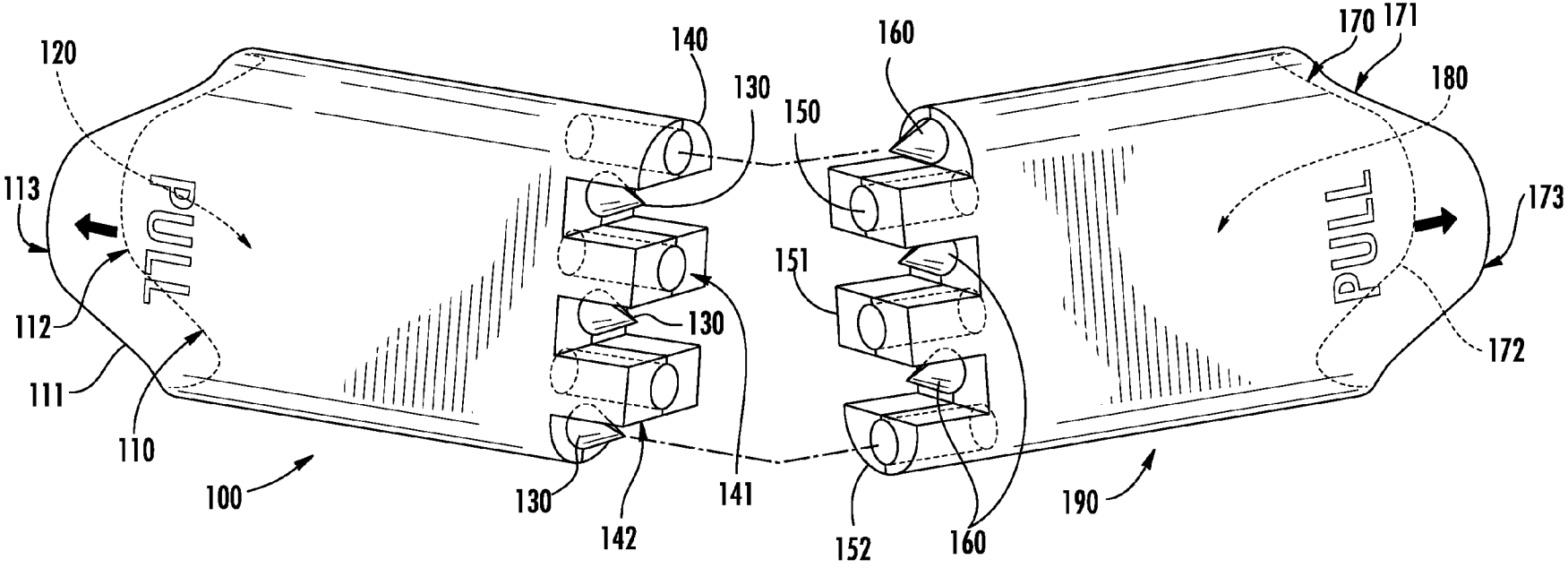
FIG. 1 illustrates an isometric view of an Advanced Condiment Dispensing Device as taught in an embodiment. The two chambered sides of the Advanced Condiment Dispensing Device are shown having 'cones' or plugs on one side of the device that are to be inserted in corresponding holes situated within columns of the opposite side of the device.

Like reference numerals refer to like parts throughout the several views of the drawings.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in the particular figure. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
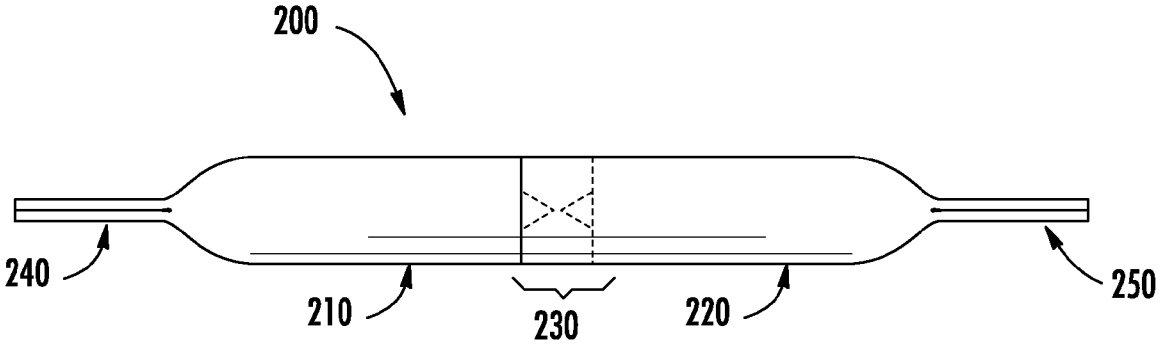
FIG. 2 illustrates a side view of an Advanced Condiment Dispensing Device as taught in an embodiment. The side view shows how the Advanced Condiment Device of the instant novelty is assembled as a single integral unit from the two sides illustrated in FIG. 1.
Figure 3:
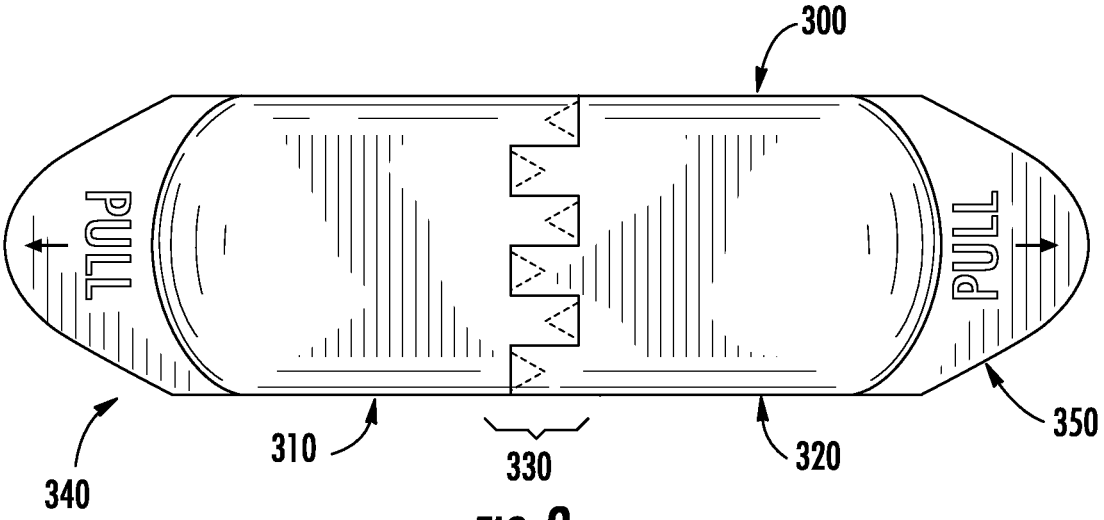
FIG. 3 illustrates a top view of an Advanced Condiment Dispensing Device as taught in an embodiment. The top view shows how the Advanced Condiment Device of the instant novelty is assembled as a single integral unit from the two sides illustrated in FIG. 1. This view in particular shows how the 'cones' or plugs cooperate with the corresponding cavities found in the columns of either side.

An Advanced Condiment Dispensing Device is presented in FIGS. 1-3 illustrating various views of the novel device taught herein. Various enhancements are presented in the figures that represent novel mechanisms to distribute more than one condiment and that provide for the easy opening of the condiment package or sachet.

FIG. 1 illustrates an isometric view of an Advanced Condiment Dispensing Device as taught in an embodiment. The device is most generally composed of two oblong rectangular packets or shells united in the center through mechanical pressure on the slanted walls of interlocking alternating columns. Thus, a slanted column on one side of the device is pressed against a slanted column on the other side of the device as fingers of two hands interlocking together; in this fashion, the material itself of the exterior walls of the columns tend to hold the interlocking surfaces together. It should also be noted that these alternating columns contain passageways whereby condiments can be dispensed from the interior of the two shells or packets through the passageway in the columns to the outside food that is to be seasoned with the contents. Finally, each packet or sachet is sealed at one end of each with a heat treated tab intended to be pulled apart by a user.

Manufacturing these devices presents a minor challenge that is overcome using any number of techniques. Some of the possible ways of manufacturing these items include that each shell or packet is made alternatively from two oblong strips of material with a central column insert; that each has two oblong strips or leaves where one of the leaves has the columns and cones or plugs integrally formed or with a single die made piece of material having all the components of a single side of the device as an integral unit. The preferred manner of making the device is forming it from two corresponding strips of material for each side that are heat treated together along the perimeter of the device; the plugs and columns are also included as part as part of either strip of material being broken in two. Upon reading the following disclosure it should be understood that any of the above alternatives are interchangeable with the discussion presented below and that the particular mention of one way of making the device does not prohibit the use of the previously mentioned alternatives or others that are available.

The two chambered sides of the Advanced Condiment Dispensing Device are shown having 'cones' or plugs 130 on a first side of the device that are to be inserted in corresponding holes situated within columns 150, 151, 152, of a second side of the device. Similarly, the 'cones' or plugs 160 on the second side of the device are to be inserted in corresponding holes situated within columns of the first side 140, 141, 142 of the device. An Advanced Condiment Dispensing Device is shown in FIG. 1 as a two sided complementary device having a left container 100 and a right container 190 that cooperatively engage together into a single integral unit. The particular type of material used for the structure of the containers creates an engagement by physical tension of the columns from either side through a 5.5% grade for the columns from the normal to the surface directly adjacent to the cones that serve as backing to the cones or plugs. As a further locking mechanism to hold the two containers 100, 190 together locking detents (not shown) can be used; these are pieces of material that extend outwards from the columns so as to mesh with a corresponding adjacent column once the two containers 100, 190 are brought into physical proximity. These detents are made from the same material as is the rest of the device.

Figure 4:
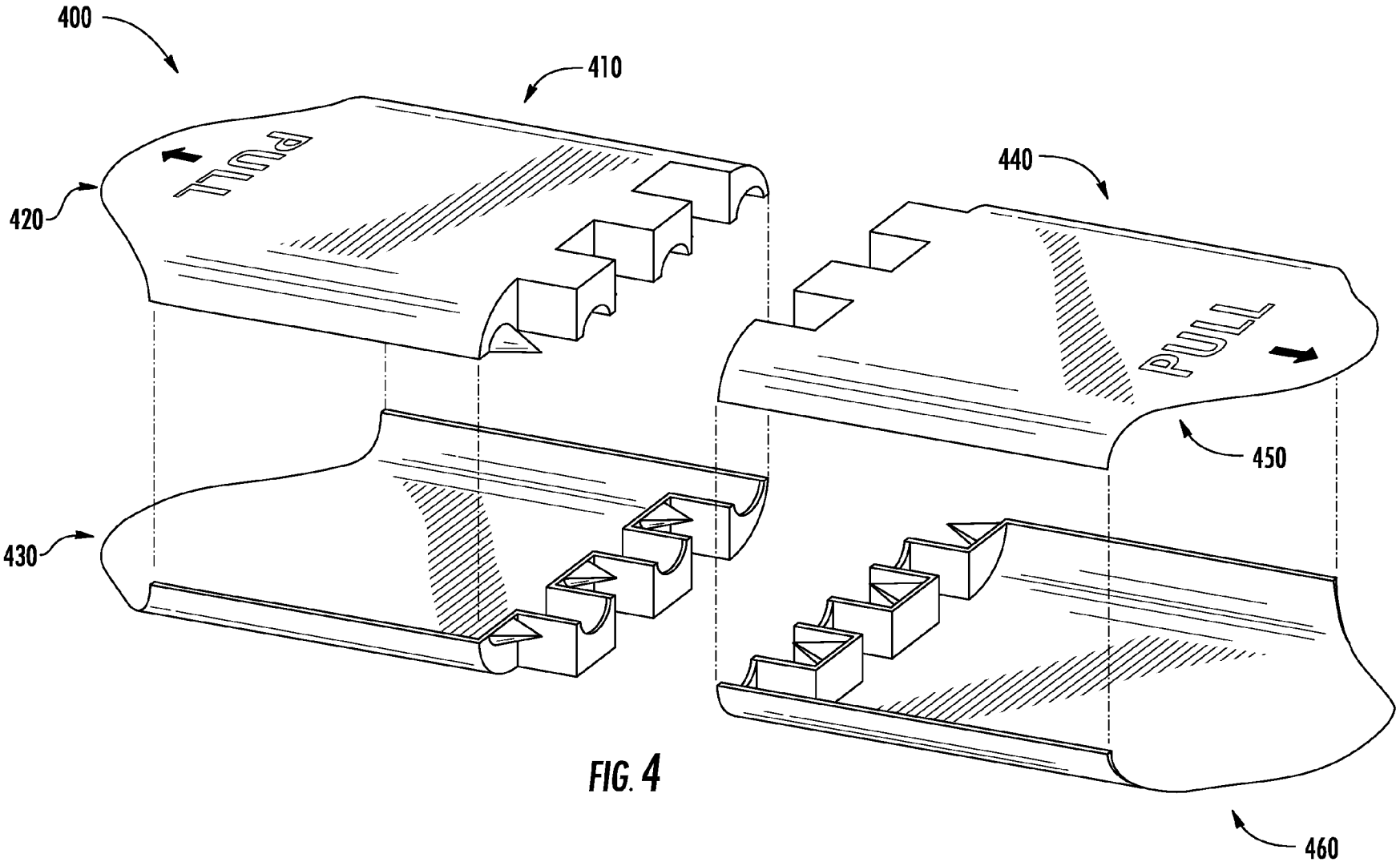
FIG. 4 illustrates a view of the two strips of material used to make a single side of the condiment package utilized in the embodiment to keep the two separate sides together.

The two side containers 100, 190 are each initially formed as two strips of material that shapes the different components as described in the following. The left container 100 of FIG. 1 has a hollowed out condiment storage area 120 between two leaves 110, 111 of plastic material that form the upper and lower portions of the container's walls. Similarly, the right container 190 has upper and lower leaves of plastic material 170, 171 that form the upper and lower portions of the container's walls surrounding a condiment storage area 180. The four leaves 110, 111 170, 171 from the left and right containers 100, 190 are formed as two leaves so that heat treatment is necessary at the longitudinal edge boundaries between the two top and bottom portions of either side container respectively; this is shown with respect to FIG. 4. Further, heat treatment will be necessary at the substantially triangular tab pulling section on the end portion of the left and right containers 100, 190 so as to finally seal the container as well as at the borders between the plugs and columns on the top strip and bottom strip as shown in FIG. 4.

Returning to the description of the containers' walls, the top leaf 110 of left container 100 flows down on into the bottom leaf 111 encountering a break due to the heat treatment as it transitions into the bottom leaf 111 as one single container wall. Then the bottom leaf 111 returns on the other side of the device to the top leaf 110 forming longitudinal sides for the package shown in FIG. 1. Similarly, the top leaf 170 of right container 190 flows down on into the bottom leaf 171 encountering a break, due to the heat treatment as it transitions into the bottom leaf 171 as one single container wall. Then the bottom leaf 171 returns on the other side of the device to the top leaf 170 forming longitudinal sides for the package shown in FIG. 1.

The left container 100 has top and bottom leaves 110, 111 that have integral end portions 112, 113 for the respective top and bottom leaves 110, 111 of left container 100. Thus, the top leaf 110 flows integrally into this endmost portion 112 to the left in FIG. 1; further, this endmost portion is substantially shaped as two legs of a triangle with a curved central vertex having external lettering directing a user to 'PULL' the device apart written above the curved vertex. Thus, the bottom leaf 111 flows integrally into this endmost portion 113 to the left in FIG. 1; further, this endmost portion is substantially shaped as two legs of a triangle with a curved central vertex having external lettering directing a user to 'PULL' the device apart written above the curved vertex.

Similarly, the right container 190 has top and bottom leaves 170, 171 that have integral end portions 172, 173 for the respective top and bottom leaves 170, 171 of right container 190. Thus, the top leaf 170 flows integrally into this endmost portion 172 to the right in FIG. 1; further, this endmost portion is substantially shaped as two legs of a triangle with a curved central vertex having external lettering directing a user to 'PULL' the device apart written above the curved vertex. Thus, the bottom leaf 171 flows integrally into this endmost portion 173 to the right in FIG. 1; further, this endmost portion is substantially shaped as two legs of a triangle with a curved central vertex having external lettering directing a user to 'PULL' the device apart written above the curved vertex. These end piece pairs 112, 113 and 172, 173 are brought together with a machine tool so that when heat treated the containers seal up the contents of the package thereby protecting the same therein from leakage or even from environmental effects. The device would not be complete, however, without an understanding as to how the condiments enclosed therein can be easily dispensed. As discussed previously, a user breaks apart the two sides that have been held together with physical tension that is a property of different materials. In this case, the polyethylene surface tension of 5.5% angled grade permits an interlocking effect between the columns once they are brought into physical proximity.

The columns when brought horizontally together are connected such that they run together numerically as 140, 150, 141, 151, 142, 152. Of course as discussed previously, the plugs or 'cones' 130, 160 cap off the corresponding column that matches it in the figure as shown. Thus, it should be easily understood that each of the columns has a dispensing hole or cavity perforating it longitudinally substantially down the center of the respective column; this hole or cavity opens up into either of the internal storage area of containers 100, 190 depending upon the location of the column. Thus, columns 140, 141, 142 have holes or cavities that perforate down the entire length of the columns and opens into storage area 120. Similarly, column 150, 151, 152 have holes or cavities that perforate down the entire length of the columns and opens into storage area 180. Further, the shape of a particular column conforms to its structural duty within the overall condiment package. For example, the two end columns 140, 152 are shown having a curved outer surface so that column is represented as a semi-circular device with the substantially flat part of the semicircular column is found internal to the device and is designed to abut the next column in the sequence. So in this description the substantially flat portion of column 140 will abut a substantially flat portion of column 150 and similarly the substantially flat portion of column 152 will abut a substantially flat portion of column 142. Finally, each of the next column walls abuts the columned wall of the next one in the sequence from the opposite side until the end semicircle wall that extends out external to the devices. Of course in this description it should be understood that the words 'substantially flat' alternatively signifies a flat surface or a device that tapers out to the end of each column at a angled grade from a normal to the surface about the cone adjacent a column that is typically 5.5%. Further, the plugs have a horizontal surface around them that helps interlock them with the adjacent columns.

FIG. 2 illustrates a side view of an Advanced Condiment Dispensing Device as taught in an embodiment. The side view shows how the Advanced Condiment Device of the instant novelty is assembled as a single integral unit from the two sides illustrated in FIG. 1. The assembled condiment device 200 is shown having the two pull strips 240 and 250 arranged on the left and right sides of the device respectively. The first container 210 is located on the left side of the device and the second container is located on the right side of the device whilst the mingled plugs and columns 230 or nozzles are arranged in the centerline of the device as shown.

FIG. 3 illustrates a top view of an Advanced Condiment Dispensing Device as taught in an embodiment. The top view shows how the Advanced Condiment Device 300 of the instant novelty is assembled as a single integral unit from the two sides illustrated in FIG. 1. This view in particular shows how the 'cones' or plugs cooperate with the corresponding cavities found in the columns of either side. The nozzles or columns with cavities and their corresponding plugs are found at a central region 330 of the device as shown in the figure. Each of the left 310 and right containers 320 are shown having heat treated pull tabs on the left 340 and the right 350 sides of the device.

FIG. 4 illustrates a view of the two strips of material used to make a single side of the condiment package utilized in the embodiment to keep the two separate sides together. The entire advanced condiment package 400 is illustrated in a disassembled view. The two containers 410 and 440 are made from two strips of material each; each of these strips of material are themselves cut from a longer piece of material or made through injection molding or similar techniques. Thus, there is a top 420 and bottom 430 strip of material that are pressed together and heat treated to form a single left side container. Similarly, there is a top 450 and bottom 460 strip of material that are pressed together and heat treated to form a single right side container.

Figure 5A:
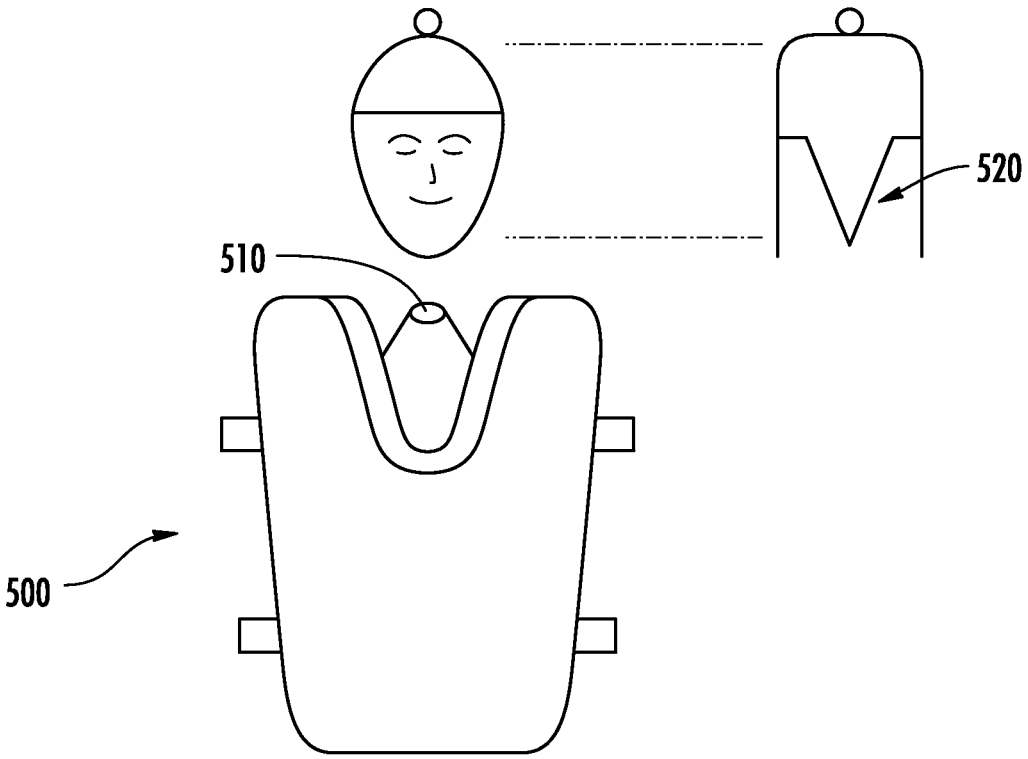
FIG. 5*a* illustrates a novelty device having a cartoon figure represented as the top of the condiment package.
Figure 5B:
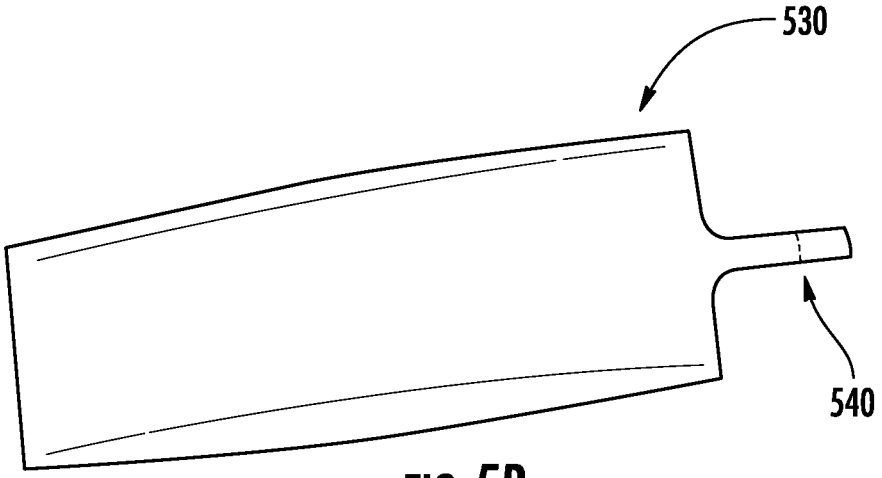
FIG. 5*b* illustrates a simple spout design incorporated in a rectangular condiment package.

FIG. 5*a* illustrates a novel device having a cartoon FIG. 500 represented as the top of the condiment package. A condiment package has the cartoon figure's head being broken from the rest of the device leaving a triangular spout 510 at the inside top of the body that is sealed by a plug 520 underneath the head of the figure as shown. Simple contact friction holds the device together or through the use of detents. Then condiments are expelled from a tiny perforation in the triangular spout that is left behind. FIG. 5*b* illustrates a novel device 530 having a simple design with a spout on one side of a rectangular condiment packet. A user removes a piece of the spout along a dotted line weakened portion 540 of the spout to be able to expel the contents thru the channel in the spout.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

I claim:

1. A system for containment of fluid materials, comprising:

a first container having:

a top and bottom surfaces attached to each other along their respective borders having an interior cavity formed between the top and bottom surfaces and integrated at a first end with:

a first nozzle having a first hole, said first hole forming a passageway communicative with an interior of said first container;

a first surface integrally associated with an exterior surface of said first nozzle wherein the first surface also has a first plug adjacently formed on the first surface to the exterior surface of said first nozzle.

2. The system for containment of fluid materials of claim 1 further comprising:

a second container.

3. The system for containment of fluid materials of claim 2, wherein the second container further comprises:

another top and bottom surfaces attached to each other along their respective borders having another interior cavity formed between the another top and bottom surfaces and integrated at a second end with:

a second nozzle having a second hole, said second hole forming a passageway communicative with an interior of said second container;

a second surface integrally associated with an exterior surface of said second nozzle wherein the second surface also has a second plug adjacently formed on the second surface to the exterior surface of said second nozzle.

4. The system for containment of fluid materials of claim 3, wherein the first plug is inserted into the second hole so that they cooperate in a closed mode to block fluid flow out of the second container.

5. The system for containment of fluid materials of claim 4, wherein the second plug is inserted into the first hole so that they cooperate in a closed mode to block fluid flow out of the first container.

6. The system for containment of fluid materials of claim 5 further comprising:

a third nozzle having a third hole, said third hole forming a passageway communicative with an interior of said first container;

a third surface integrally associated with an exterior surface of said third nozzle wherein the third surface also has a third plug adjacently formed on the third surface to the exterior surface of said third nozzle.

7. The system for containment of fluid materials of claim 6, further comprising:

a fourth nozzle having a fourth hole, said fourth hole forming a passageway communicative with an interior of said second container;

a fourth surface integrally associated with an exterior surface of said fourth nozzle wherein the fourth surface also has a fourth plug adjacently formed on the fourth surface to the exterior surface of said fourth nozzle.

8. The system for containment of fluid materials of claim 7, wherein the third plug is inserted into the fourth hole so that they cooperate in a closed mode to block fluid flow out of the second container.

9. The system for containment of fluid materials of claim 8, wherein the fourth plug is inserted into the third hole so that they cooperate in a closed mode to block fluid flow out of the first container.

10. The system for containment of fluid materials of claim 9 further comprising:

a fifth nozzle having a fifth hole, said fifth hole forming a passageway communicative with an interior of said first container;

a fifth surface integrally associated with an exterior surface of said fifth nozzle wherein the fifth surface also has a fifth plug adjacently formed on the fifth surface to the exterior surface of said fifth nozzle.

11. The system for containment of fluid materials of claim 10, further comprising:

a sixth nozzle having a sixth hole, said sixth hole forming a passageway communicative with an interior of said second container;

a sixth surface integrally associated with an exterior surface of said sixth nozzle wherein the sixth surface also has a sixth plug adjacently formed on the sixth surface to the exterior surface of said sixth nozzle.

12. The system for containment of fluid materials of claim 11, wherein the fifth plug is inserted into the sixth hole so that they cooperate in a closed mode to block fluid flow out of the second container.

13. The system for containment of fluid materials of claim 12, wherein the sixth plug is inserted into the fifth hole so that they cooperate in a closed mode to block fluid flow out of the first container.

14. The system for containment of fluid materials of claim 13 wherein said first and second container have separable cooperative retention of both containers in order to keep them as a single system.

15. The system for containment of fluid materials of claim 14 wherein said first and second container have separable cooperative retention of both containers in order to keep them as a single system such that mechanism used to keep the containers together is the friction between said nozzles.

16. The system for containment of fluid materials of claim 14 wherein said first and second container have separable cooperative retention of both containers in order to keep them as a single system such that mechanism used to keep the containers together are retentive notches.

* * * * *